US005217225A

United States Patent [19]

Dubarry, Jr.

[11] Patent Number: 5,217,225

[45] Date of Patent: Jun. 8, 1993

[54] BOARD GAME SPINNER ASSEMBLY

[76] Inventor: A. P. Dubarry, Jr., 4514 Charmion La., Encino, Calif. 91316

[21] Appl. No.: 969,956

[22] Filed: Nov. 2, 1992

[51] Int. Cl.[5] ..... A63F 5/04

[52] U.S. Cl. ..... 273/141 R

[58] Field of Search ..... 273/141 R, 141 A, 287

[56] References Cited

U.S. PATENT DOCUMENTS 3,633,915 1/1972 Lippert ..... 273/141 R

*Primary Examiner*—Benjamin H. Layno

*Attorney, Agent, or Firm*—Larry F. Gitlin

[57] ABSTRACT

An improved portable spinner assembly for use primarily in combination with a board game, including a first base member, an apertured post member formed integrally with the first base member and a rotatable spinner element with an arrow shaped forward section and a rear section having a generally feather-like angular appearance. Located medially of the spinner element and formed integrally with that element is an apertured shank member. A second base member in the shape of a disc includes an aperture formed in the center section to receive the apertured post member. The second base member, which is substantially heavier and has a larger diameter than the first base member, is adapted to be placed over and then lowered to the upper surface of the first base member by initially aligning the aperture in the second base member with the apertured post member and then lowering the second base member down over the post. The spinner element is attached to the first base member by inserting the shank into the aperture formed inside the post and then snapping the shank into place.

3 Claims, 1 Drawing Sheet

FIG. 1
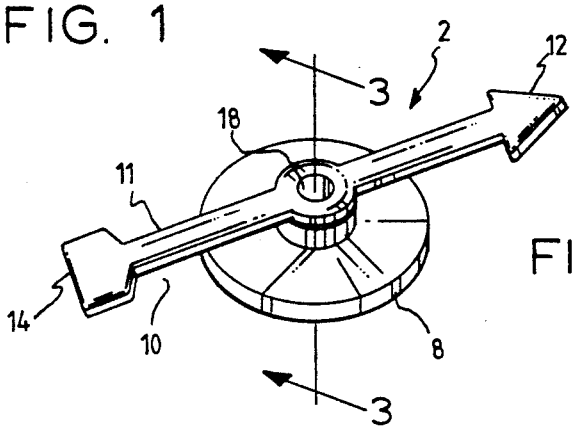
FIG. 2
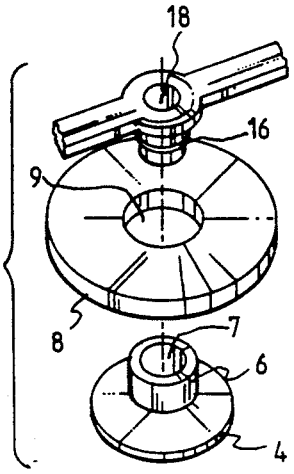
FIG. 3
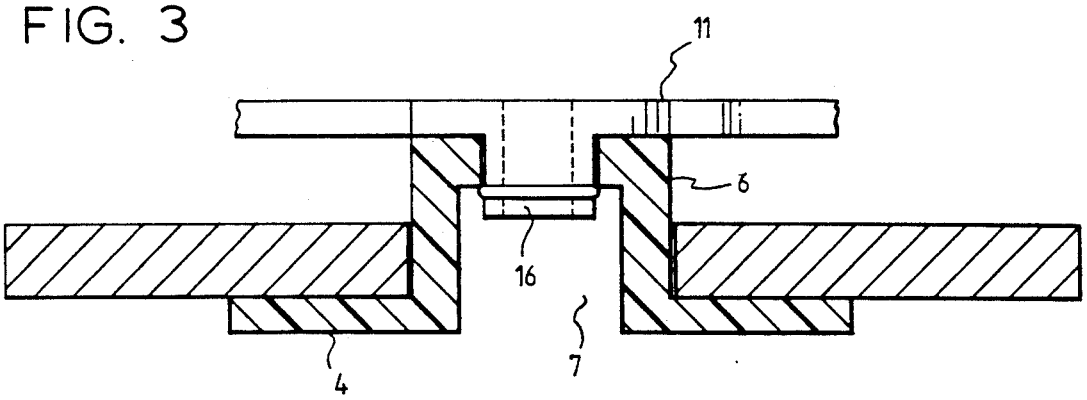
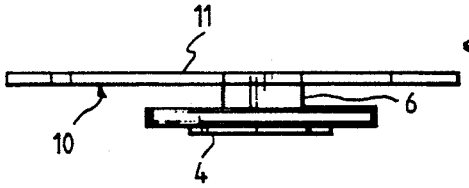
FIG. 4
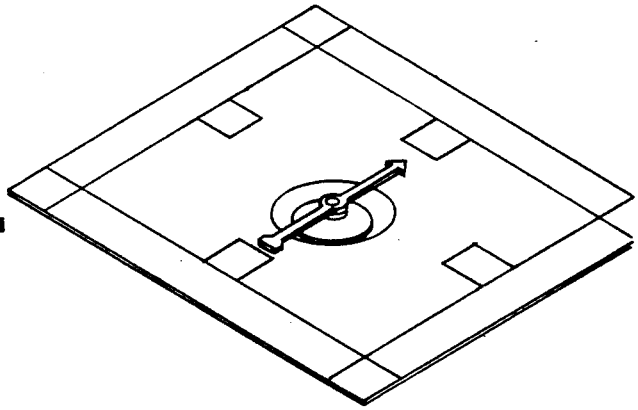
FIG. 5

BOARD GAME SPINNER ASSEMBLY

BACKGROUND OF THE INVENTION

1. Field of the Invention

The present invention relates generally to the field of board games and novelty devices and, more particularly, to an improved spinner assembly for use in conjunction therewith.

2. Description of the Prior Art

The prior art discloses a variety of spinner and rotatable indicator devices of the type used primarily with games of entertainment and chance.

U.S. Pat. No. 4,243,223 to Ver Hoef et al. discloses a device consisting of a cylindrical post element, a rotatable apertured spinner element and a resilient base member containing a suction cup bottom for mounting the device directly to the surface of a game board.

U.S. Pat. No. 3,933,357 to Mercer et al. discloses a spinner assembly consisting of a disc, a spinner shaft and a pivotally mounted pointer arm adapted for demountable attachment to a series of spinner cards bearing a variety of game relevant indicia.

U.S. Pat. No. 4,508,344 to Krogh discloses a relatively complex spinner assembly that includes a base, a raised section above the base, and an upper section situated above the raised section. A rotatable spinner element is supported by a pin rising above a circular pedestal situated in the center of the upper section. Interchangeable indicia cards are provided and include a large hole in the center with a diameter slightly larger than the diameter of the pedestal. The central hole accommodates the spinner's pointer. The interchangeable indicia cards are mounted on the upper section just beneath the spinner.

U.S. Pat. No. 2,224,996 to Walsh consists of a spinner device for a board game comprising a base, a vertically disposed socket adapted to receive a spindle and an indicator element or spinner mountable on the spindle. The socket, which is fixed medially of the base, is vertically disposed and includes a cavity through the center with a rounded bottom and an upper terminal section. A seat is disposed inside the cavity immediately below the upper terminal. The rounded bottom terminal is designed to receive an anti-friction ball bearing. The spindle, which contains a shank with a couple of annular phalanges, is inserted into the socket with the lower end of the shank sitting upon the anti-friction bearing and the upper end of the shank resting upon the seat situated just inside the upper terminal. The spinner element contains an aperture for receiving a post extending vertically from the uppermost end of the spindle. The spinner is connected to the assembled components by engaging the upsetting stub at the upper end of the spindle.

The present invention is a substantial improvement over the prior art, including particularly the devices previously described. The invention resolves many of the problems that these devices appear to have overlooked. Among the improvements is the ability of the present invention to remain extremely steadfast and balanced on the game board surface even under conditions where the indicator is vigorously rotated. The prior art devices rely upon a variety of inappropriate and sometimes complicated means to anchor them down in an attempt to ensure their stability when the spinner is impelled at high velocities. The use of a suction cup in the base is one such example. However, a suction cup will eventually lose its suction force and, along with that, the loss of the spinner's stability on the board. The suction cup is also inclined to leave unsightly suction marks on the game board surface. Among the other prior art means are the physically broad based assemblies that are integrated with the spinner element, such as the devices disclosed in Mercer and Krogh. The drawback of the Walsh device is that it requires intricate tooling and includes an excess of component parts. In contrast, relatively few components are used in the assembly of the device of the present invention—three in all. There is also an ease of disassembly of the present invention for repair, replacement or storage that has no equal among the devices of the prior art. Unlike most of the prior art devices, the spinner of the present invention is also raised high above the base. Thus, there is little risk now of inadvertently striking the base with the finger in an attempt to rotate the spinner and propelling the device across the board surface knocking over game pieces and playing cards in the process.

An important feature advanced by the device of the present invention over the prior art is its unique dual base components. A single base element produced of plastic or some similar resilient material is too light weight to provide the necessary stability and balance required of a device of this kind. A single base element made of metal or some other kind of high density material, though seemingly heavy enough to provide the requisite degree of stability and balance necessary for the device to operate properly, nevertheless has substantial drawbacks. Thus, we know from our study of the prior art that most base components require an apertured shank or some similar component for the spinner shaft to engage and rotate about. This requires a certain amount of intricate tooling to produce the unitary base and shank component to enable the component to engage the shaft and allow the two elements to join and then snap together. The cost of manufacturing a base of this kind is unreasonably high, since the tooling of a metal component is much more costly than the tooling of a plastic or more resilient alternative. Given the highly competitive climate in the game board industry these days, each component of a board game, from the box it comes in to the smallest playing piece in the game, is considered in the overall attempt at cost savings. This is an absolute critical consideration, particularly when a major object involved in the manufacture and marketing of a board game is to keep the product as affordable for the general public as possible. With the present invention, this object is achieved. Accordingly, only the smaller, plastic base component of the present invention requires the necessary intricate tooling, a relatively inexpensive process when involving plastic, while the larger, heavier base component made of metal, which supplies the ballast and the balance, does not. These features, among others, constitute significant improvements over the prior art.

SUMMARY OF THE INVENTION

The present invention consists of an improved portable spinner assembly for use primarily in combination with a board game. The assembly includes a first base member, an apertured post member formed integrally with the first base member and a rotatable spinner element with an arrow shaped forward section and a rear section having a generally feather-like angular appearance. Located medially of the spinner element and formed integrally with that element is an apertured shank member. The invention also includes a second base member in the shape of a disc and an aperture formed in the center section of the second base member designed to receive the apertured post member extending from the first base member. The second base member is substantially heavier and has a larger diameter than the first base member. The second base member is adapted to be placed over and then lowered to the upper surface of the first base member by initially aligning the aperture in the second base member with the apertured post member and then lowering the second base member down over the post. The spinner element is attached to the first base member by inserting the shank into the aperture formed inside the post and then snapping the shank into place.

Accordingly, an object of the present invention is to provide a spinner device that is readily disassembled for repair, replacement or storage.

Another object of the present invention is to provide a spinner device having major characteristics including separable base elements with one of the base elements having a diameter substantially larger and weighing considerably more than the other, an apertured post formed integrally with the smaller base element and a spinner indicator with a shank element engageable with said apertured post.

Still yet another object of the present invention is to provide a spinner device which is portable and easily maneuverable upon the surface of the game board.

Still yet another object of the present invention is to provide a device which is easy to use and inexpensive to manufacture.

Still yet another object of the present invention is to provide a device which, though not attached to the game board, when impelled by one's finger to rotate the spinner component to a high velocity, will nevertheless remain steadfast and resist horizontal relative movement across or off the game board surface.

Other objects and advantages of the present invention will become apparent in the following specifications when considered in light of the attached drawings wherein the preferred embodiment of the invention is illustrated.

BRIEF DESCRIPTION OF THE DRAWINGS

FIG. 1 is a perspective view of the spinner device of the present invention.

FIG. 2 is an exploded perspective view of the spinner device of the present invention showing the main components before assembly.

FIG. 3 is a cross-sectional view of the spinner device of the present invention taken along the line 3—3 of FIG.1

FIG. 4 is a side elevational view of the device of the present invention.

FIG. 5 is a perspective view of the spinner device of the present invention shown positioned on a game board.

DETAILED DESCRIPTION OF THE PREFERRED EMBODIMENT

FIG. 1 illustrates a preferred embodiment of the spinner device of the present invention which is designated generally as 2. There are three main components of the present invention. The first is a base member 4, which is made of plastic or some similar resilient material and has a protruding post member 6 disposed vertically thereof. Post member 6 contains an aperture 7 therein. The second component is base member 8, which is typically made of a heavier material, such as a metal alloy, and has an aperture 9 located in the center thereof. Base member 8 has a diameter substantially larger than the diameter of base member 4 and is generally much heavier than base member 4. The third component is an indicator element 10 having a shaft 11 with a forward end 12 shaped generally like an arrowhead and a rearward end 14 having a generally rectangular shape. Alternatively, end 14 is designed in the approximate shape of a feather, such as the kind formed at the back end of a conventional sporting or hunting arrow. Located medially of the indicator element 10 and formed integrally therewith is a vertically disposed shank member 16 including an aperture 18. The diameter of shank 16 is slightly smaller than the diameter of the aperture 9 to enable these two components to easily engage and then secure their connection.

In a typical application of the present invention, the device 2 is assembled by first placing the base member 4 on the flat surface of a game board, preferably in a location that does not obstruct any of the game indicia, pieces, cards or related items. Post member 6 is then aligned under the aperture 9 to enable the base member 8 to easily slip down around the post member 6 and come to rest upon the upper surface 5 of the base member 4. The indicator element 10 is attached to the post member 6 by inserting the shank 16 into the aperture 7 and then snapping the shank 16 into place by the use of any conventional attachment means appropriate to connect and secure the two. The average height of the indicator element 10 is ¼" above the upper surface of base member 8, though this dimension may vary. The larger and heavier base member 8 acts to stabilize the base member 4, which supports it. These two factors allows the finger to impel the indicator element 10 to a high velocity rotation without the risk of accidentally striking the base in the process and propelling the device 2 across the board into other game pieces or cards situated on the board surface.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

I claim:

1. An improved portable spinner apparatus for use in combination with a board game having a relatively flat surface comprising:

a generally circular shaped first base member having an upper surface and a lower surface, an apertured first post member formed integrally with said first base member and disposed vertically from the upper surface of said first base member, a rotatable spinner element having a shaft with an upper surface, a lower surface, a pointed forward section and a rearward section with a generally feather-like appearance, said spinner element having incorporated therein at the approximate midpoint between the forward section and the rearward section a second post member having a downward orientation from said lower surface, said second post member having a diameter that is slightly smaller than the diameter of said apertured first post member to enable said second post member to be inserted and then rotatably secured within said apertured first post member, an apertured disc shaped second base member having an upper surface and a lower surface, a diameter that is greater than the diameter of the first base member and smaller than the length of the spinner element, a weight that is substantially greater than the weight of the first base member and an aperture diameter that is slightly larger than the diameter of said apertured first post member to enable said post member to engage and protrude through said aperture in said second base member allowing said second base member to be lowered down upon and supported by the upper surface of said first base member such that the distance between the upper surface of the second base member and the upper surface of the spinner element is approximately ¼" whereby said second base member will extend radially to ensure by virtue of its size and weight relative to the size, weight and position of the first base member and the spinner element that said spinner assembly will remain steady and balanced, and resist horizontal relative movement across the game board surface when the spinner element is rotated to a high velocity.

2. The invention of claim 1 wherein the spinner apparatus is readily disassembled for repair, replacement or storage.

3. The invention of claim 1 wherein said base member is comprised of plastic and said second base member is comprised of a metal alloy.

* * * * *